US006578725B2

(12) United States Patent
Delman et al.

(10) Patent No.: US 6,578,725 B2
(45) Date of Patent: Jun. 17, 2003

(54) CONTAINER LID WITH FINGER-RECEIVING SCOOP

(75) Inventors: Joel G. Delman, Chicago, IL (US); Steve T. Josephson, Los Angeles, CA (US)

(73) Assignee: Traffic Works, Inc., Huntington Park, CA (US)

( * ) Notice: Subject to any disclaimer, the term of this patent is extended or adjusted under 35 U.S.C. 154(b) by 93 days.

(21) Appl. No.: 09/780,447

(22) Filed: Feb. 12, 2001

(65) Prior Publication Data

US 2002/0108952 A1 Aug. 15, 2002

(51) Int. Cl.[7] ..... B65D 51/00
(52) U.S. Cl. ..... 220/212; 220/735
(58) Field of Search ..... 220/212, 735; 215/228; 401/129, 127

(56) References Cited

U.S. PATENT DOCUMENTS

| | | | | | |
|---|---|---|---|---|---|
| 1,834,085 | A | * | 12/1931 | Bloom | 215/228 |
| 1,840,662 | A | * | 1/1932 | Fischer | 215/228 |
| 2,106,313 | A | * | 1/1938 | Amrine | 215/228 |
| 2,485,303 | A | * | 10/1949 | Marcus | 401/129 |
| 3,380,307 | A | | 4/1968 | De Frank | |
| 3,487,974 | A | * | 1/1970 | Schovee | 220/212 |
| 4,219,283 | A | * | 8/1980 | Buckley et al. | 401/129 |
| 4,226,456 | A | | 10/1980 | Barnett | |
| 4,432,466 | A | * | 2/1984 | Allen | |
| D302,793 | S | * | 8/1989 | Yamaguchi | D7/643 |
| 5,149,506 | A | * | 9/1992 | Skiba et al. | |
| 5,251,774 | A | | 10/1993 | Engle | |
| 5,586,676 | A | | 12/1996 | Lynd | |
| 5,642,689 | A | | 7/1997 | Harvey | |
| 5,682,931 | A | | 11/1997 | Mouchmouchian | |
| 5,775,531 | A | | 7/1998 | Lowry | |
| 5,791,505 | A | | 8/1998 | Gilliland | |
| 5,970,922 | A | | 10/1999 | Lin | |
| D438,979 | S | * | 3/2001 | Gomes et al. | D7/691 |

FOREIGN PATENT DOCUMENTS

| | | | |
|---|---|---|---|
| CH | 672873 | * | 1/1990 |

* cited by examiner

*Primary Examiner*—Nathan J. Newhouse
(74) *Attorney, Agent, or Firm*—Liniak, Berenato & White

(57) ABSTRACT

A lid that creates a seal around a container to allow proper storage and reduce spoil time of the contents. Integrally formed with the lid is a scoop extending into the can so that the contents may be removed without soiling another utensil. The lid is adapted to securely attach to a container opening. The scoop portion has a finger-receiving cavity to allow for simplified operator use. The finger-receiving scoop extends from the underside of the lid into the container. The scoop is nearly the length of the container and is used to assist an individual to remove the contents of the container. Once finished, the individual may seal the container with the lid until further use is desired, preventing the spoiling of the remaining food inside.

14 Claims, 4 Drawing Sheets

CONTAINER LID WITH FINGER-RECEIVING SCOOP

BACKGROUND OF THE INVENTION

1. Field of the Invention

This invention relates generally to a lid for various types of containers that incorporates a scoop device. More specifically, this invention provides a convenient means to cleanly scoop contents from a container and then reseals the container for storage until further use is desired.

2. Description of Related Art

There exists an enormous waste of economy when scooping food, whether intended for pet or human consumption, from a container or can. Cans often contain more substance than is desired for a single sitting. Thus, there is a need to store the unused portion either in a separate container or by somehow covering the container. After removing the portion to be used, there remains a smelly and dirty scoop, usually a spoon or similar utensil.

Several prior art patents relate to the art of dog drop scoops. U.S. Pat. No. 4,226,456 to Barnett provides a container and lid wherein a scoop is incorporated with the lid for the removed of dog droppings in the urban environment. Meanwhile, U.S. Pat. No. 5,970,922 to Lin provides an animal box consisting of a box body, a cover, and a carrying body to remove and carry dung from an animal.

Similarly, prior art patents exist relating to lids with incorporated spoons, cups, and stirrers; see U.S. Pat. No 5,586,676 to Lynd, U.S. Pat. No. 5,642,689 to Harvey, U.S. Pat. No. 5,682,931 to Mouchmouchian, U.S. Pat. No. 5,775,531 to Lowery and U.S. Pat. No. 5,791,505 to Gilliland.

It is highly desirable to provide a lid with an integrally formed scoop that may provide a seal for a particular container. This design will only require a single cleansing of the scoop rather than multiple washings of one or more utensils. The lid may be used with any can of like diameter. Additionally, lids of various sizes may be manufactured to correspond to containers of all diameters.

The need therefore exists for a device comprising a lid with a finger-receiving cavity extending into an integrally formed scoop. The finger-receiving cavity allows for stable operation of the scoop. Further, the lid provides an airtight seal around the container to prevent spoiling of food within.

SUMMARY OF THE INVENTION

It is therefore an advantage of the present invention to provide a lid, adapted to securely attach to a container opening. The lid preferably, but not necessarily, incorporates a finger-receiving scoop that extends from the underside of the lid into the container. The scoop is nearly the length of the container and is used to assist an individual to remove the contents of the container. Once finished, the individual may seal the container with the lid, preventing the spoiling of the remaining food inside. The lid further creates a seal around the container to allow for storage until further use is desired. This feature of the invention eliminates the need to use multiple scoops with a single container.

The invention also encompasses an extendable scoop device suitable for different sized containers.

These advantages and other novel features of the present invention will become apparent in the following detailed description of the invention when considered in conjunction with the accompanying drawings.

BRIEF DESCRIPTIONS OF THE DRAWINGS

A better understanding of the present invention will be had when reference is made to the accompanying drawings, wherein identical parts are identified by identical reference numbers and wherein.

DETAILED DESCRIPTION OF THE PRESENT INVENTION

Figure 1:
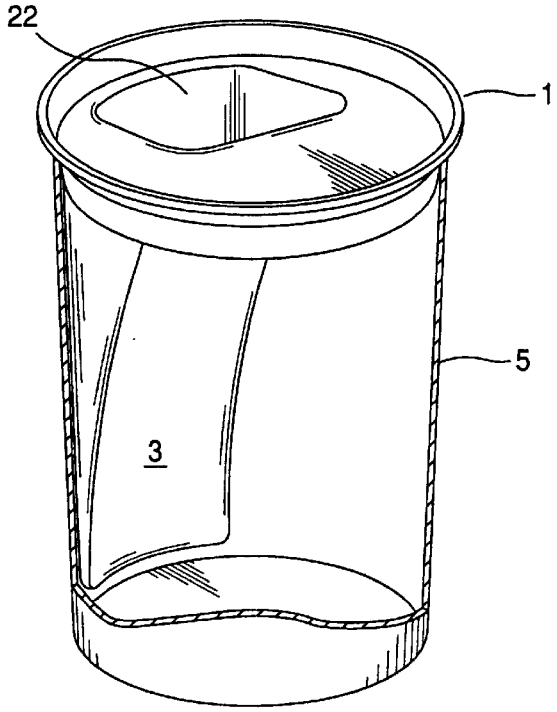
FIG. 1 is a perspective view of the invention coupled with a container.

Referring to FIG. 1, the lid 1 is shown surmounted in the usual manner on a container 5. Any container 5 may be used that has the required diameter and a minimum depth in order to house the scoop 3 once the lid 1 engages the container 5.

Figure 2:
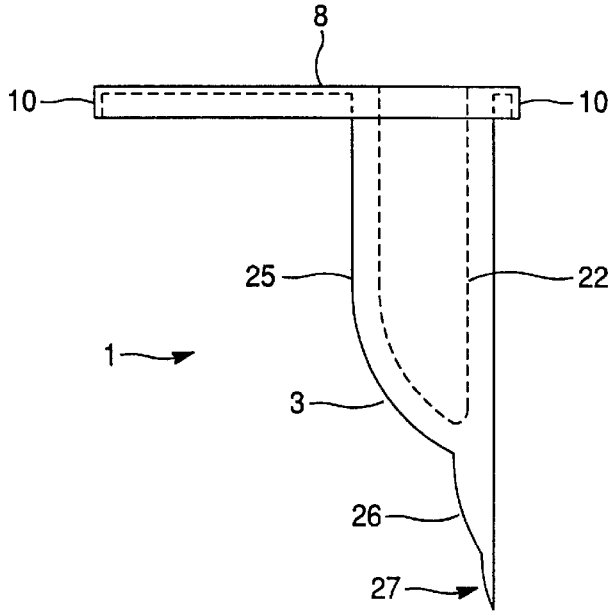
FIG. 2 is a schematic view of the present invention.

Referring to FIG. 2, as is well known in the art, the lid 1 is made of rigid material and is of circular configuration as viewed from the top or bottom and is adapted to overlie a cylindrical container 5 of a circular cross-section. The lid 1 has a top planar surface 8 that is disk-shaped with a rim portion 10 to accommodate emplacement of the lid 1 onto the open mouth of a container 5. Extending from the planar surface of the lid 8 is a scoop 20 with a finger-receiving cavity 22.

The rim portion 10 extends in a direction perpendicular from the planar surface of the lid 8 along the entire outer edge of the planar surface of the lid 8. The rim portion 10 is thus provided about the perimeter of the lid for securing the member to the circular top free edge of an open cylindrical container 5.

Figure 3:
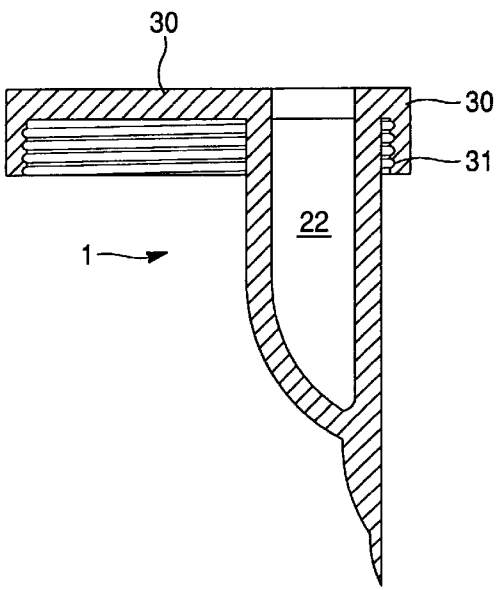
FIG. 3 is a cross sectional view of another embodiment of the invention with a rim portion for rotating on a container.

FIG. 3 shows an alternate embodiment of the invention where the rim portion 30 is threaded with grooves 31 to engage threads on a container (not shown). The lid 1 is rotated so that the threads on a container and the grooves 31 on the rim portion 30 are engaged; an airtight seal is then formed preventing the contents of the container from spoiling.

Referring again to FIG. 2, the lid 1 has an integrally formed scoop 20 extending from the planar surface of the lid 8 adjacent to the rim portion 10. In the preferred embodiment, the planar surface of the lid 8 and the scoop 3 are formed as a homogenous body as will be described below; however, this is not the only method in which the device may be formed. In the preferred embodiment, the scoop 3 has a curved surface and is concentric with the circular edge of the disk shaped lid 1 to minimize the space with the container 5 occupied by the scoop 3. The scoop slightly tapers from its base at the lid surface 8 adjacent to the rim portion towards the geometric center of the disk-shaped lid 1. Formed during molding, the scoop 3 contains a finger-receiving recess 22. The recess 22 is an opening in the planar surface of the lid 8 and projects into the body of the scoop 3. The recess 22 is large enough wherein operation of the lid 1 and scoop 3 may be facilitated by manipulation, i.e., one or more fingers are placed within the recess 22 and a thumb is placed on the opposite side's rim portion 10. The finger-receiving recess 22 extends half the length of the scoop 20 from the planar surface of the lid 8. The inner edge 24 of the scoop is tapered in stages from the planar surface of the lid 8. Wherein the first tapered stage 25 travels the length of the finger-receiving recess 22, the second tapered stage 26 travels from the end of the first tapered stage 25 to the beginning of the third tapered stage 27, and the third tapered stage 27 travels from the end of the second tapered stage 26 to the end of the scoop 3. Alternate embodiments need not have separate stages; embodiments with two stages or a single tapered stage may also be used.

Figure 5:
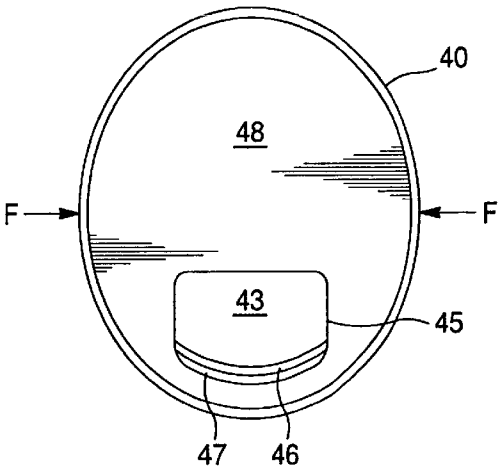
FIG. 5 is a perspective view from the bottom of another embodiment of the invention after application of a force.
Figure 4:
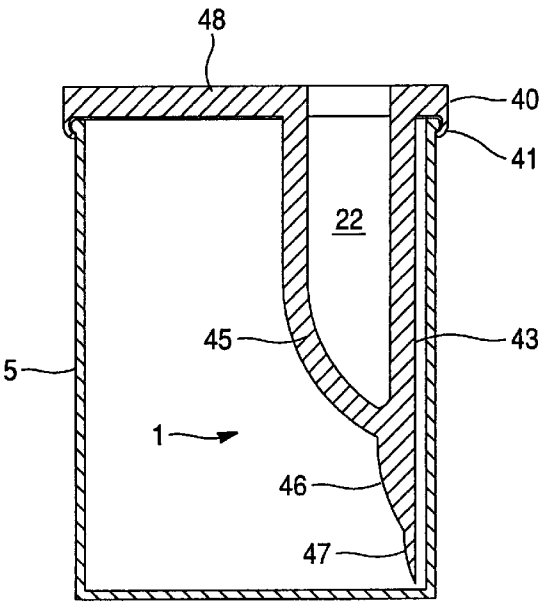
FIG. 4 is a cross sectional view of another embodiment of the invention made with a resilient material.

In an alternate embodiment as seen in FIGS. 4–5, the top planar surface of the lid 48 is made of resilient material, such as polyethylene. FIG. 3 shows the rim portion 40 as having a bottom edge projection 41. The bottom edge projection 41 engages the lip of a container 5 to create a seal. Referring to FIG. 4, upon application of a force F to opposing edges of the rim portion 40, the planar surface of the lid 48 flexes and deforms resulting in a smaller diameter at the locations where the forces F were applied. The diminished diameter produced by the force F application allows a user to insert the planar surface of the lid 48 past the open upper circumferential threshold of the container thereby allowing the scoop 43 to reach the entire depth of the container 5. Thus, in the event the container's 5 depth is deeper than that of the scoop's 44 length, a user may reach into the container 5 with the scoop 44 by deforming the planar surface of the lid through application of a force F to the rim portion 40.

Figure 6:
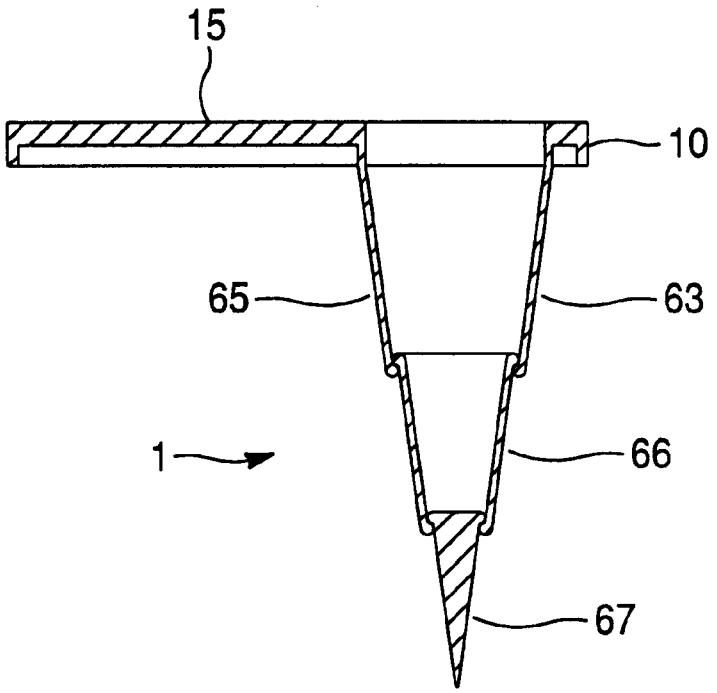
FIG. 6 is a cross sectional view of another embodiment of the invention with the integral scoop extended.
Figure 7:
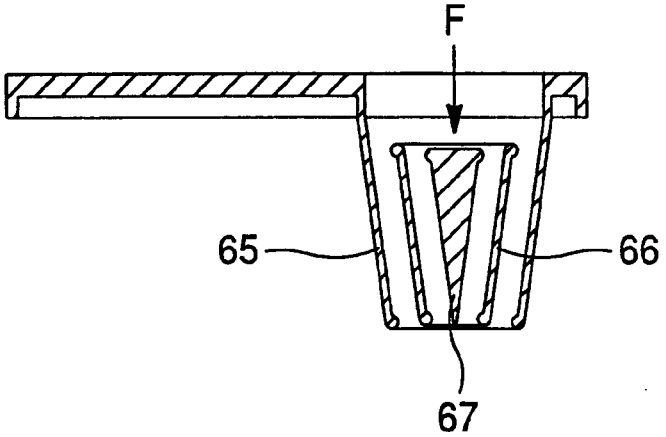
FIG. 7 is a cross sectional view of another embodiment of the invention with the integral scoop is the collapsed position.
Figure 8:
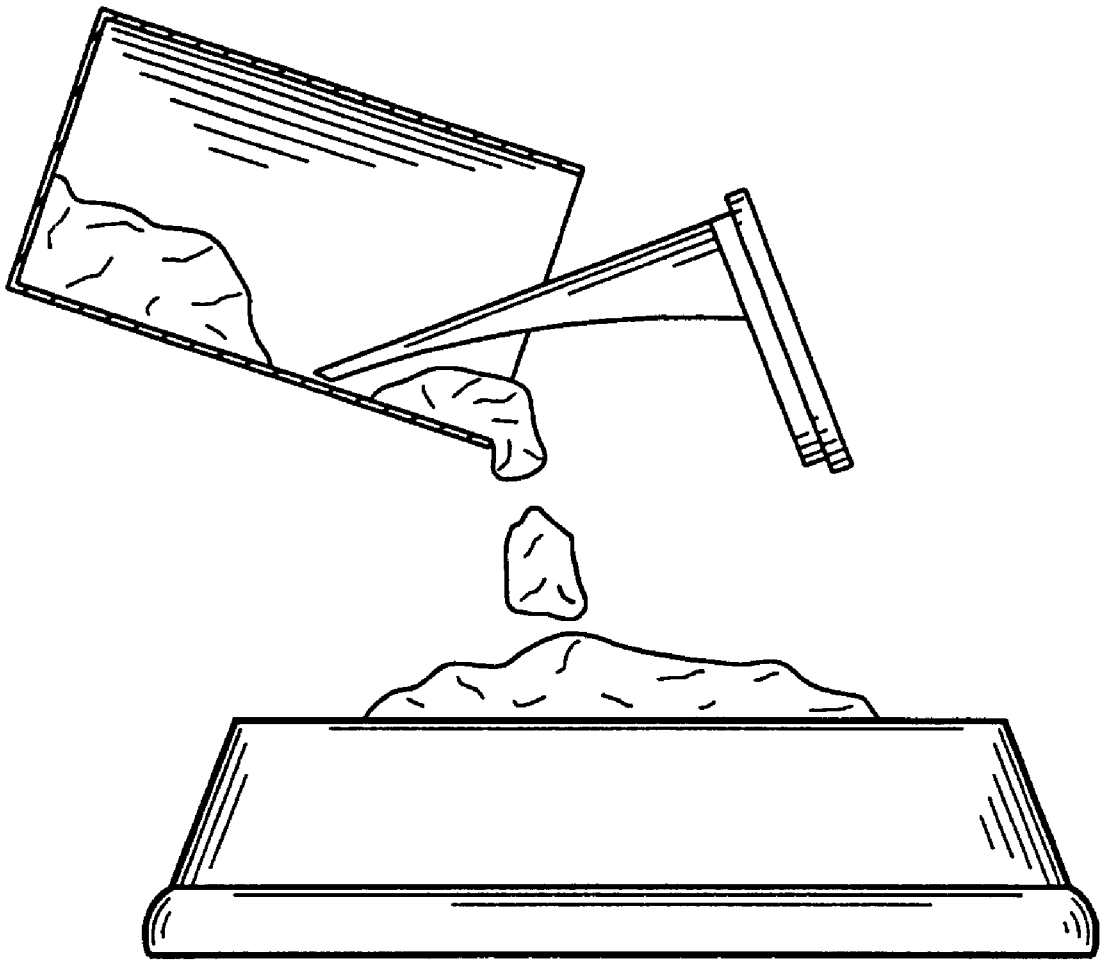
FIG. 8 is a perspective view of the container lid with finger-receiving scoop in use relative to a bowl.

Finally, referring to FIGS. 6–7, in this embodiment of the invention, the scoop 43 expands and collapses. The second and third stages 66, 67 collapse into the first stage 65 allowing for a greater storage volume with in the container (not shown). The first stage 65 is fixed to the planar surface 15 and extends downward. At the bottom of the first stage 65 there is a lip projecting inward. The lower lip of the first stage 65 engages the lip of the second stage 66 and prevents the second stage 66 from completely dislocating itself when extended. Thus, the second stage 66 has an upper lip projecting outward to engage the lower lip of the first stage 65. The second stage 66 also has a lower lip that projects inward to engage the upper lip of the third stage 67. The second stage's 66 center is carved out allowing the third stage 67 to recede up into the second stage 66 when the scoop is in a collapsed position. Similarly, the third stage 67 has an upper lip to engage the lower lip of the second stage 66.

FIG. 7 shows the embodiment when in the collapsed position. In order for a user to extend the scoop 64, a force F is applied to facilitate extension of all three stages.

The features of the invention as explained above, eliminate the need to use multiple scoops with a single container. Thus, a lid 1, adapted to securely attach to a container 5 opening, is formed with an integral scoop 20. The lid's finger receiving scoop 22 that extends from the underside of the planar surface of the lid 8 into the container 5. The scoop 20 is nearly the length of the container 5 and is used to assist an individual to remove the contents of the container 5. The rim 10 provides the individual with a means to seal the container 5, preventing the spoiling of the remaining food inside. When the lid 1 is used in such a fashion, food may be stored for an extended period of time.

While the foregoing invention has been shown and described with reference to several preferred embodiments, it will be understood that various changes in form and detail may be made without departing from the spirit and scope of the present invention. For example, the exact shape and disposition of the scoop may be varied in any number of ways to provide the most efficient and effective removal of the article within the container, and the manner by which the article is removed from the container may be varied in a number of ways (e.g., extendable scoop, bendable lid/scoop, usability on a variety of containers). Likewise, the fastening system connecting the lid and scoop to the container may be varied to accommodate a variety of containers and rims (e.g., screw-top, can-opener top, snap-fit, etc.).

What is claimed is:

1. A device for selectively removing an article from a container, said device comprising:

a disk-shaped planar surface, a rim portion circumscribing said planar surface for engaging a corresponding opening of said container via a friction-fit engagement, a scoop extending from said disk-shaped planar surface, wherein said scoop projects away from said disk-shaped planar surface, and a finger-receiving cavity projecting away from said disk-shaped planar surface into said scoop.

2. The device of claim 1, wherein said scoop is integrally formed as a homogenous body with said disk-shaped planar surface.

3. The device of claim 2, said scoop further comprising a curved surface with a first radius of curvature that matches a second radius of curvature defined by the inner surface of said container to thereby minimize the occupied volume of said container by said scoop.

4. The device of claim 1, wherein said scoop is one of selectively extended and selectively collapsed.

5. The device of claim 4, said scoop further comprising a curved surface with a first radius of curvature that matches a second radius of curvature defined by the inner surface of said container to thereby minimize the occupied volume of said container by said scoop.

6. The device of claim 1, wherein said disk shaped planar surface is a flexible body.

7. The device of claim 6, wherein said scoop is integrally formed as a homogenous body with said disk-shaped planar surface.

8. The device of claim 6, said scoop further comprising a curved surface with a first radius of curvature that matches a second radius of curvature defined by the inner surface of said container to thereby minimize the occupied volume of said container by said scoop.

9. The device of claim 1, wherein said rim portion rotatably secures to said container.

10. A combination container and closure device for selectively removing an article from said container, said combination comprising:

a container comprising:

an article-receiving portion for receiving said article, and an opening of said container and a closure device comprising:

a disk-shaped top portion, a rim portion circumscribing said top portion for engaging said opening a scoop extending from said disk-shaped top portion, wherein said scoop projects away from said disk-shaped planar surface, and a finger receiving cavity projecting away from said disk-shaped top portion into said scoop.

11. The combination of claim 10, wherein said scoop comprises a curved surface with a first radius of curvature that matches a second radius of curvature defined by the inner surface of said container to thereby minimize the occupied volume of said container by said scoop.

12. The combination of claim 10, wherein said scoop is one of selectively extended and selectively collapsed.

13. The combination of claim 10, wherein said disk shaped top portion is a flexible body.

14. The combination of claim 10, wherein said scoop is integrally formed as a homogenous body with said disk-shaped top portion.

* * * * *